US005784340A

United States Patent [19]

Kanai

[11] Patent Number: 5,784,340

[45] Date of Patent: Jul. 21, 1998

[54] PIEZOELECTRIC ACOUSTIC DEVICE

[75] Inventor: Yasuhiro Kanai, Tokyo, Japan

[73] Assignee: Taiyo Yuden Co., Ltd., Tokyo, Japan

[21] Appl. No.: 664,384

[22] Filed: Jun. 14, 1996

[30] Foreign Application Priority Data

Jul. 31, 1995 [JP] Japan ..... 7-215316

[51] Int. Cl.[6] ..... H04R 17/00

[52] U.S. Cl. ..... 367/140; 381/173; 381/190; 310/322; 310/324; 310/334

[58] Field of Search ..... 367/140; 381/173, 381/190; 310/322, 324, 334

[56] References Cited

U.S. PATENT DOCUMENTS

| | | | |
|---|---|---|---|
| 4,078,160 | 3/1978 | Bost | 310/331 |
| 4,184,093 | 1/1980 | Sullivan | 310/331 |
| 4,379,211 | 4/1983 | Joscelyn et al. | 179/110 A |
| 4,841,493 | 6/1989 | Meisner et al. | 367/140 |
| 5,195,142 | 3/1993 | D'Avolio et al. | 381/173 |

FOREIGN PATENT DOCUMENTS

| | | |
|---|---|---|
| 54-92181 | 12/1952 | Japan . |
| 54-21296 | 2/1979 | Japan . |
| 56-48951 | 11/1981 | Japan . |

*Primary Examiner*—J. Woodrow Eldred
*Attorney, Agent, or Firm*—Flynn, Thiel, Boutell & Tanis, P.C.

[57] ABSTRACT

A piezoelectric acoustic device comprises a piezoelectric element composed of a metallic plate-shaped diaphragm, a plate-shaped piezoelectric body, electrodes provided on both main surfaces of the piezoelectric body, one electrode being fixed and electrically connected to a main surface of the diaphragm, and a casing for accommodating the piezoelectric element therein and forming a resonant chamber together with the piezoelectric body. The piezoelectric element further comprises a projection projecting from the diaphragm and an extension electrode, the extension electrode being extended onto the projection while being insulated from the diaphragm, the extension electrode being electrically connected to another electrode which is not fixed to the diaphragm of the piezoelectric body, the piezoelectric element being attached to the casing while allowing a main surface of the projection attaching the extension electrode thereto to direct outward. Further, a metallic surface portion of the projection and the extension electrode are respectively electrically connected to circuit patterns of a printed circuit board mounted inside the housing by way of conductive portions provided on an elastic connection block. Accordingly, the device can be miniaturized, and simplified in the structure thereof, and further easily connected to the circuit.

14 Claims, 5 Drawing Sheets

PIEZOELECTRIC ACOUSTIC DEVICE

BACKGROUND OF THE INVENTION

1. Field of the Invention

The present invention relates to a piezoelectric acoustic device having a piezoelectric element adapted for use in an acoustic device such as a receiver of a telephone, etc.

2. Prior Art

A conventional piezoelectric acoustic device comprises a case like a tray for accommodating a piezoelectric element therein, a stepped piezoelectric element support provided at an inner peripheral side of the case at the intermediate portion thereof, wherein a peripheral portion of a diaphragm is placed on and fixed to the piezoelectric element support by an adhesive. In the piezoelectric element, one of the electrodes provided on both surfaces of a plate-shaped piezoelectric body is bonded to a surface of the diaphragm wherein lead wires are respectively connected to the electrode on the piezoelectric element and the diaphragm and are extended outside from the case.

Such a piezoelectric acoustic device is incorporated into an electronic device such as a portable telephone, a so-called cordless phone, then it is fixed to the housing by screws, etc. Further, the lead wires are connected to a printed circuit board in the housing by soldering, etc.

In addition to the piezoelectric acoustic device connected by the lead wires, there is a piezoelectric acoustic device having no lead wires wherein conductive pins provided in the case contact the diaphragm and the electrodes of the piezoelectric element so as to connect to the circuit. This piezoelectric acoustic device is also accommodated in the housing of the electronic device and is fixed to the housing by screws, etc.

However, in the aforementioned piezoelectric acoustic devices, since the case attaching the piezoelectric element thereto is employed, parts count is increased, steps of assembly are increased, so that the manufacturing cost can not be reduced and the miniaturization of the device is difficult. When the case is fixed to the housing, lead wires must be soldered, which take however much time and labor.

SUMMARY OF THE INVENTION

In view of the drawbacks of the conventional piezoelectric acoustic device, it is an object of the invention to provide a piezoelectric acoustic device in which a piezoelectric element is easily fixed to an electronic device, and is connected to a circuit without taking time and labor so that it can be manufactured with low cost and can be miniaturized. Accordingly, the electronic device can be easily assembled.

To achieve the above object, in the present invention, a projection is provided on a periphery of a metallic plate-shaped diaphragm of a piezoelectric element, and an extension electrode electrically extended onto a main surface of the projection wherein the extension electrode is electrically connected to the diaphragm of a plate-shaped piezoelectric body while allowing the extension electrode to be insulated from the diaphragm. The piezoelectric element is directly fixed to a housing, and the extension electrode and the projection are electrically connected to circuit patterns on the printed circuit board which is accommodated in a housing of an electronic device by way of conductive portions of an elastic connection block.

A piezoelectric acoustic device comprises a piezoelectric element composed of a metallic plate-shaped diaphragm, a plate-shaped piezoelectric body, electrodes provided on both main surfaces of the piezoelectric body, one electrode being fixed and electrically connected to a main surface of the diaphragm, and a casing for accommodating the piezoelectric element therein and forming a resonant chamber together with the piezoelectric body. The piezoelectric element further comprises a projection projecting from the diaphragm and an extension electrode, the extension electrode being extended onto the projection while being insulated from the diaphragm, the extension electrode being electrically connected to another electrode which is not fixed to the diaphragm of the piezoelectric body, the piezoelectric element being attached to the casing while allowing a main surface of the projection attaching the extension electrode thereto to direct outward. Further, a metallic surface portion of the projection and the extension electrode are respectively electrically connected to circuit patterns of a printed circuit board mounted inside the housing by way of conductive portions provided on an elastic connection block. Accordingly, the device can be miniaturized, and simplified in the structure thereof, and further easily connected to the circuit. In this case, the connection block is clamped between the projection supported by an electrode supporting portion of the housing and the printed circuit board 36 while compression stress is given therebetween.

The connection block is an elastic block having a plurality of conductive portions provided at least on the surface thereof, wherein the conductive portions are arranged alternately in a given interval while being insulated therebetween. The housing includes a holding means for holding the connection block for temporarily fix the connection block thereto when the piezoelectric acoustic device is incorporated into the housing of the electronic device.

Further, the housing includes a sound damper.

In the aforementioned piezoelectric acoustic device, the extension electrode provided on the projection of the diaphragm and the surface of the projection are connected to the circuit patterns of the printed circuit board using the elastic connection block, which dispenses with soldering of the lead wires. Since the piezoelectric element is directly attached to the inside of the housing of the electronic device, it is not necessary to attach the piezoelectric element to the housing and to fix the housing by screws etc. That is, the connection block is clamped between the projection supported by the electrode supporting portion of the housing and the printed circuit board while compression stress is given therebetween and the connection between the piezoelectric element and the circuit of the printed circuit board is completed by merely attaching the piezoelectric element to the inside of the housing and fixing the housing in a given condition.

Since the connection block is an elastic block having a plurality of conductive portions which are provided at least on the surface thereof and are arranged alternately in a given interval while being insulated therebetween, when the connection block is clamped between the projection supported by the electrode supporting portion of the housing and the printed circuit board while compression stress is given therebetween, the diaphragm and the electrodes of the piezoelectric body can be easily connected to the circuit patterns of the printed circuit board. Particularly, if the housing includes a holding means for holding the connection block, when the piezoelectric acoustic device is incorporated into the housing of the electronic device, the connection block can be temporarily fixed to the housing, which enhances the incorporation of the piezoelectric acoustic device into the housing. Further, since the housing includes a sound damper, the piezoelectric acoustic device can attain excellent acoustic characteristics although it has a small size and a simple structure.

BRIEF DESCRIPTION OF THE DRAWINGS

FIG. 1(*b*) is a longitudinal cross-sectional side view of the piezoelectric acoustic device when it is assembled;

PREFERRED EMBODIMENT OF THE INVENTION

A preferred embodiment of the invention will be now described in detail with reference to the attached drawings.

First Embodiment (FIG. 1 through FIG. 9)

FIGS. 1 through 5 show a first embodiment which applies the invention to a piezoelectric receiver. A housing 1 of an electronic device such as a portable phone, a cordless phone, etc. comprises a pair of shell members 31 and 37 made of resins, etc. wherein these shell members 31 and 37 are overlaid on each other and fixed to each other using screws, etc., not shown, thereby forming a space therein for accommodating an electronic device.

Figure 2:
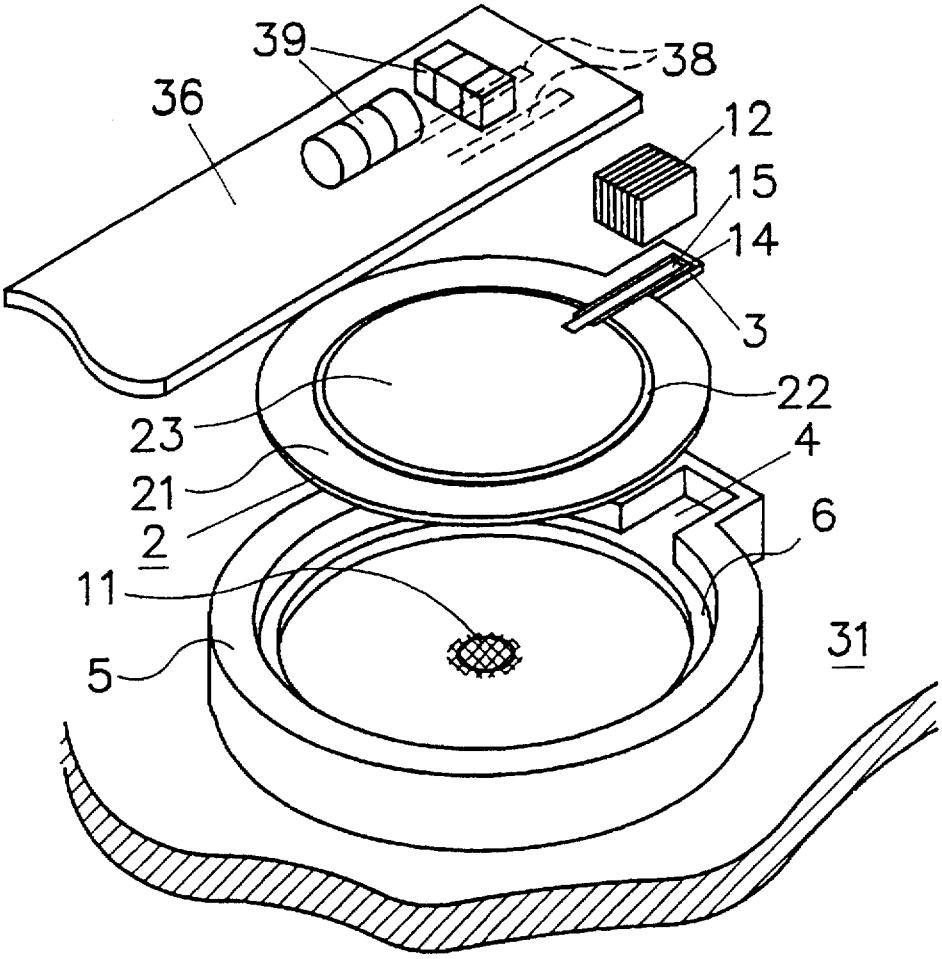
FIG. 2 is an exploded perspective view of an electric device employed by the piezoelectric acoustic device of FIG. 1 removing a shell member of a housing thereof.
Figure 3:
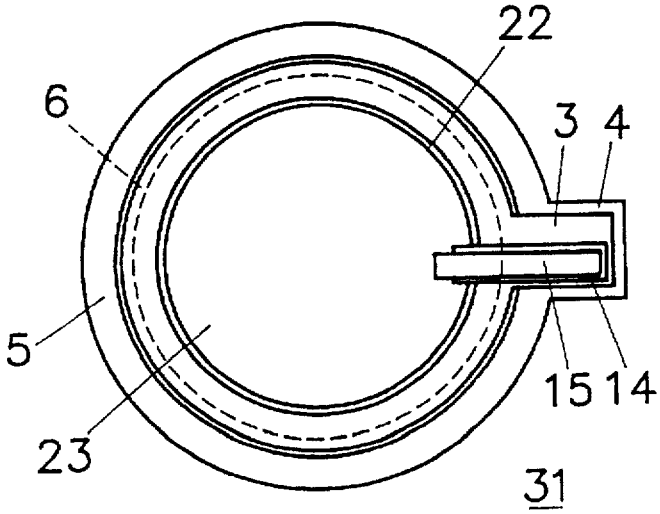
FIG. 3 is a plan view showing a state where the piezoelectric element is attached to the other shell member of the piezoelectric acoustic device of the first embodiment.
Figure 4:
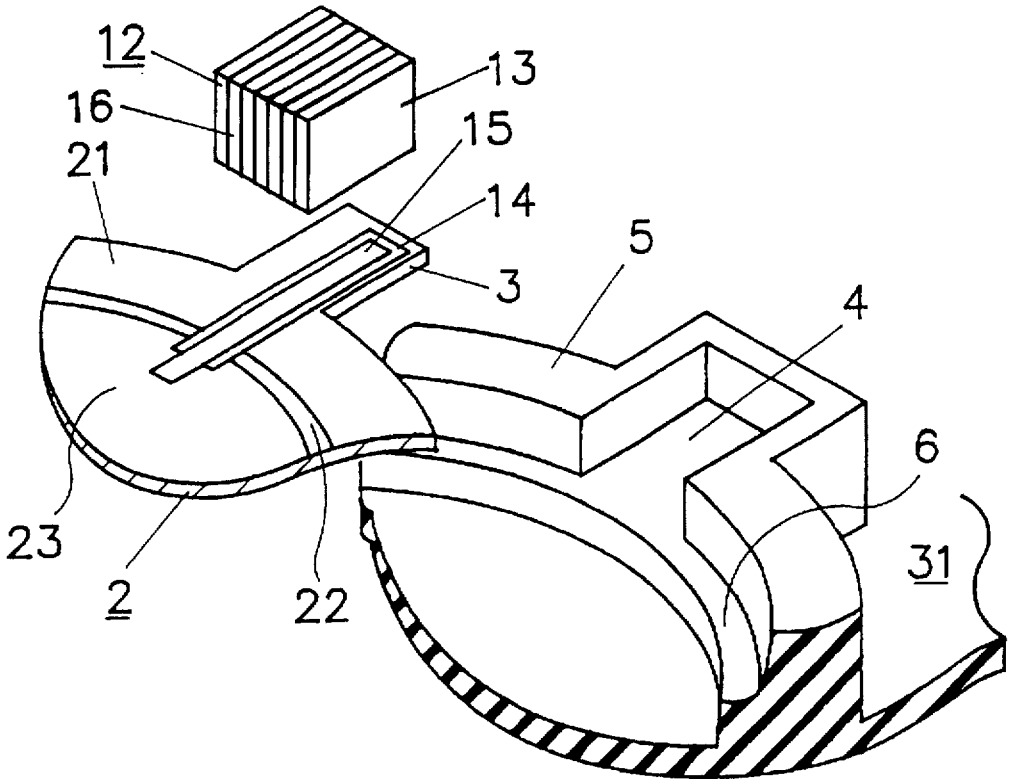
FIG. 4 is an exploded perspective view showing a main portion of the electric device employing the piezoelectric acoustic device of FIG. 1 removing one housing thereof.

As shown in FIGS. 2 through 4, a peripheral wall 5 is formed in the inner surface of one shell member 31, and a sound damper 11 comprises a hole which is bored at the central bottom part surrounded by the peripheral wall 5 and is covered with a mesh made of Tetoron (trademark) having about #380 meshes. The sound damper 11 can select a suitable shape of various shapes depending on acoustic characteristics to be obtained, for example, it can be formed of a plurality of small sound emitting holes.

An electrode supporting portion 4 projects from a part of the peripheral wall 5. The electrode supporting portion 4 is like a groove having inner dimensions corresponding to the dimensions of a projection 3 which projects radially from a peripheral portion of a diaphragm 21 of a piezoelectric element 2, described later.

The electrode supporting portion 4 projects radially from an outer peripheral portion of the housing 1. A step 6 is formed on an inner peripheral wall 5 of the housing 1 at the middle portion thereof in the direction of the inner height of the peripheral wall 5 and extends along the entire periphery of the housing 1 excepting the electrode supporting portion 4 for supporting the peripheral portion of the diaphragm 21 of the piezoelectric element 2.

As shown in FIGS. 2 through 5, the piezoelectric element 2 comprises a plate-shaped piezoelectric body 22 made of piezoelectric ceramics, etc., and electrodes 23 provided on both main surfaces of the piezoelectric body 22 (only one of the electrodes 23 is seen and illustrated in FIG. 2. through 5). One of the electrodes 23 of the piezoelectric body 22 is fixed and electrically connected to the metallic diaphragm 21. The diaphragm 21 and the piezoelectric body 22 of the piezoelectric element 2 are respectively circular. A diameter of the diaphragm 21 of the piezoelectric element 2 is slightly greater than an inner diameter of the step 6 of the housing 1, and is slightly less than an inner diameter of the peripheral wall 5 at the upper portion of the step 6.

Figure 5:
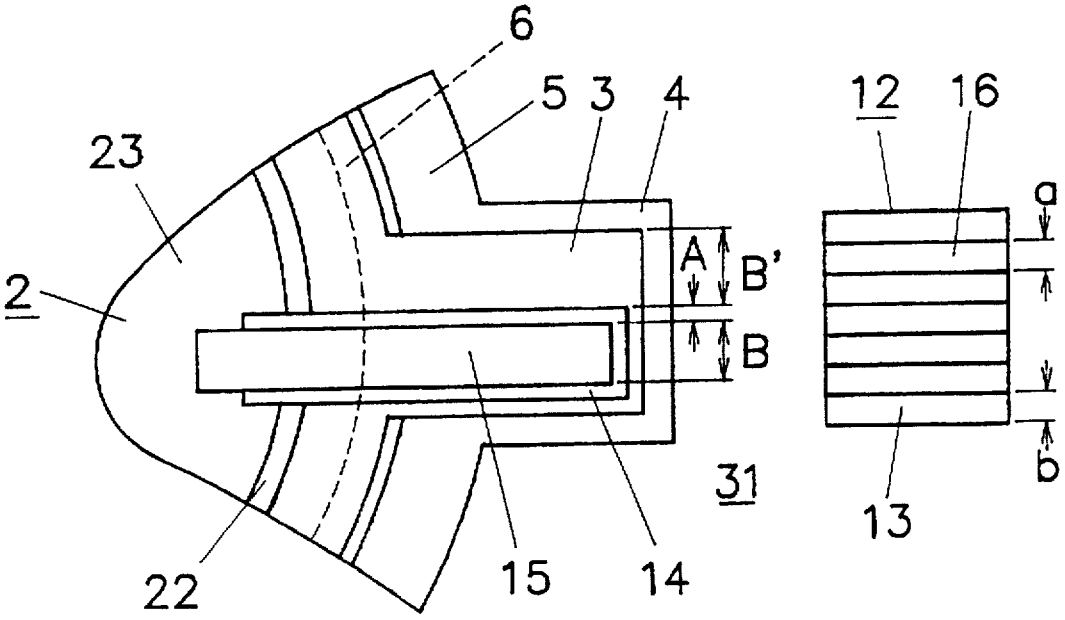
FIG. 5 is a plan view showing a state where a main portion of the piezoelectric element is attached to the shell member of the piezoelectric acoustic device of the first embodiment.

As shown in FIGS. 1 through 5, the projection 3 projects from the peripheral portion of the diaphragm 21 and also projects radially, i. e. in a direction of the radius of the diaphragm 21. A belt-shaped insulating layer 14 is formed to extend from the electrodes 23 of the piezoelectric body 22 to the projection 3. A belt-shaped extension electrode 15 composed of a conductive film is formed on the insulating layer 14. The extension electrode 15 extends over an edge of the end of the insulating layer 14 at the side of the electrodes 23 of the piezoelectric body 22 wherein the end portion of the extension electrode 15 contacts the electrodes 23 so that the extension electrode 15 is electrically connected to the electrodes 23. As shown in FIG. 5, the insulating layer 14 and the extension electrode 15 are respectively deflected on the projection 3, namely, formed at one side of the projection 3, while the metallic surface of the projection 3 is exposed at the other side of the projection 3. In FIG. 5, a width of the extension electrode 15 is denoted at B and a width of the portion of the projection 3 where the metallic surface is exposed is denoted at B'. A margin between the edge of the extension electrode 15 and that of the insulating layer 14 is denoted at A.

Further, according to the piezoelectric acoustic device of this embodiment, a connection block 12 shown in FIGS. 4 and 5 is prepared. The connection block 12 is a block as disclosed, e.g. in Japanese Patent Publication No. 56-48951 or an elastic block which is commercially available in the name of "INTERCONNECTOR", wherein insulating portions 13 and conductive portions 16 are arranged alternately in a given pitch at least on a surface of the elastic block 12. For example, the connection block 12 is formed of a layered body in which elastic insulating bodies and elastic conductive bodies each having a given thickness are respectively alternately layered, or it is formed of an elastic block in which a surface of the connection block 12 is metalized in a given interval like a belt.

A width of the connection block 12 is slightly greater than the inner dimensions of the electrode supporting portion 4 of the housing 1. Each width of the insulating portions 13 is denoted at b and each width of the conductive portions 16 is denoted at a. The following dimensional relations or expressions are established between the extension electrode 15, the insulating layer 14, and the metallic surface of the projection 3.

$$A>a,\ B>b,\ B'>b.$$

To incorporate the piezoelectric element 2 having such an arrangement into the housing 1, an adhesive such as a silicon adhesive is uniformly coated previously on the step 6 within the inner periphery of the peripheral wall 5 of the shell member 31 of the housing 1 provided with the sound damper 11 which includes a damper means such as a meshed damper cloth made of fluorine resin or a pin hole damper. Next, the piezoelectric element 2 is accommodated inside the peripheral wall 5 while the piezoelectric body 22 is directed upward, and the peripheral portion of the diaphragm 21 of the piezoelectric element 2 is placed on and fixed to the step 6 by the adhesive. At this time, the projection 3 is engaged in the electrode supporting portion 4 of the shell member 31. It is possible to select a suitable shape and structure of the damper 11 among various shapes and structure depending on the acoustic characteristics to be obtained. In such a manner, the piezoelectric element 2 is attached to the inner side of the peripheral wall 5 of the shell member 31.

Figure 1A:
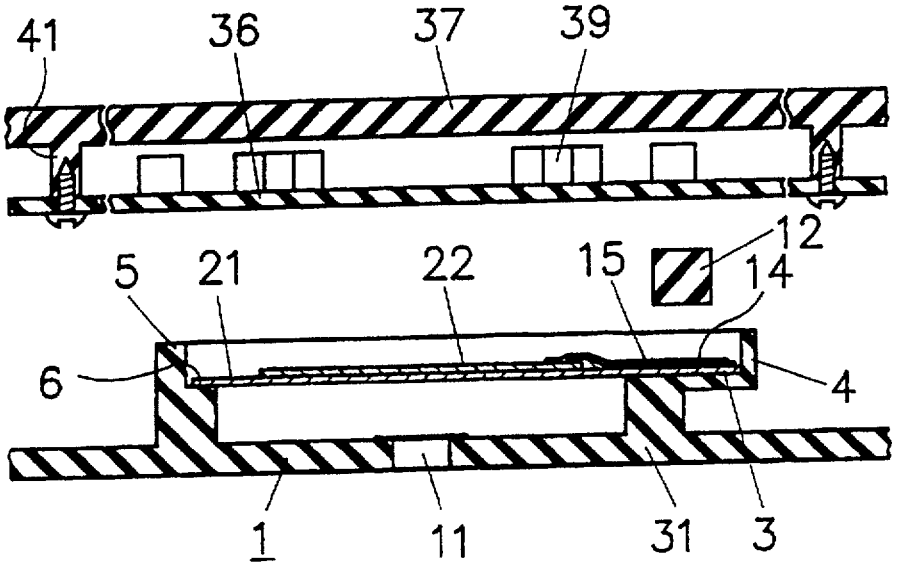
FIG. 1(*a*) is an exploded longitudinal cross-sectional side view of a piezoelectric acoustic device when it is disassembled according to a first embodiment of the invention.
Figure 1B:
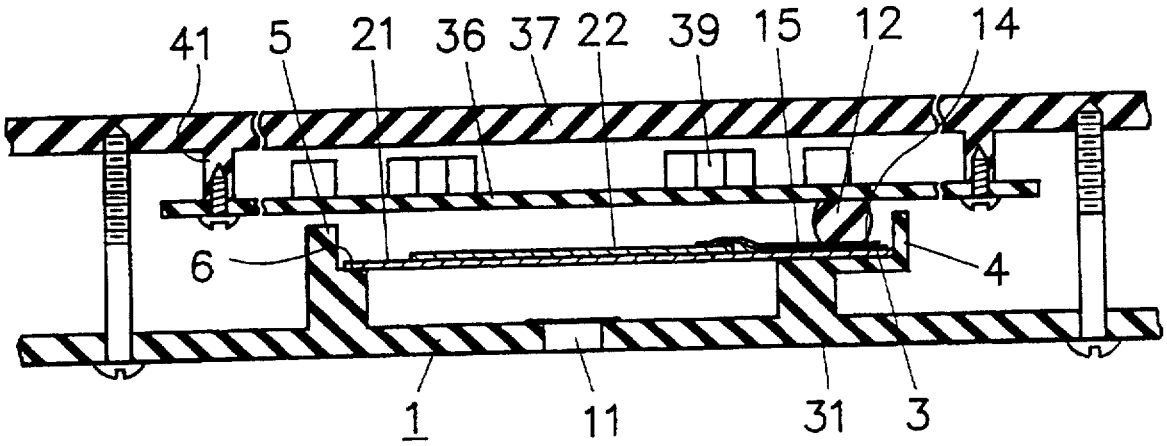

Whereupon, a printed circuit board 36 is supported or held by a board support portion 41 within the other shell member 37 constituting the housing, wherein circuit patterns 38 and 38 (refer to FIG. 2) to be connected to the diaphragm 21 and the electrodes 23 of the piezoelectric element 2 are provided on the lower surface of the printed circuit board 36 in FIG. 1. In FIG. 1, denoted at 39 is a circuit component mounted on the printed circuit board 36 and it constitutes circuits for driving the piezoelectric element 2, etc.

Successively, the connection block 12 is engaged inside the electrode supporting portion 4 of the shell member 31. Since the width of the connection block 12 is slightly greater than the inner dimensions of the electrode supporting portion 4, the connection block 12 is slightly compressed in the width direction and engaged in the electrode supporting portion 4. Accordingly, the connection block 12 is temporarily fixed inside the groove of the electrode supporting portion 4 so that it is prevented from dropping off. In this state, the other shell member 37 is overlaid on the shell member 31, then these shell members 31 and 37 are fixed to each other by screws, not shown, thereby assembling the housing.

As shown in FIG. 1(*b*) showing a state where the housing is assembled, the board support portion 41 of the other shell member 37 to which the printed circuit board 36 is attached strikes against the peripheral wall 5 of the shell member 31 so as to receive the clamping force of the screws set forth above. In this state, the connection block 12 is slightly compressed in the direction of its height and fixed to the electrode supporting portion 4. The extension electrode 15 and the metallic surface of the projection 3 are respectively connected to the circuit patterns 38 of the printed circuit board 36 (refer to FIG. 2) by way of the conductive portions 16 of the connection block 12 (refer to FIGS. 4 and 5). As a result, the piezoelectric element 2 is connected to the circuit mounted on the printed circuit board 36 for driving the piezoelectric element 2.

Figure 6A:
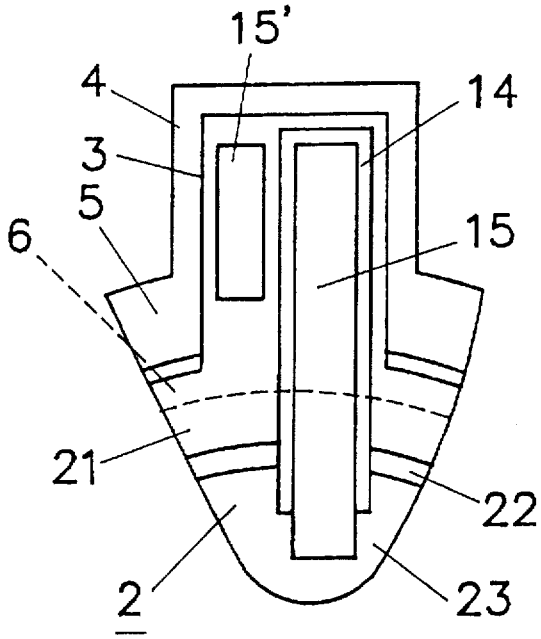
FIGS. 6(*a*) and 6(*b*) are plan views showing main portions of projections of diaphragms of the piezoelectric acoustic device according to a modification of the first embodiment of the invention.
Figure 6B:
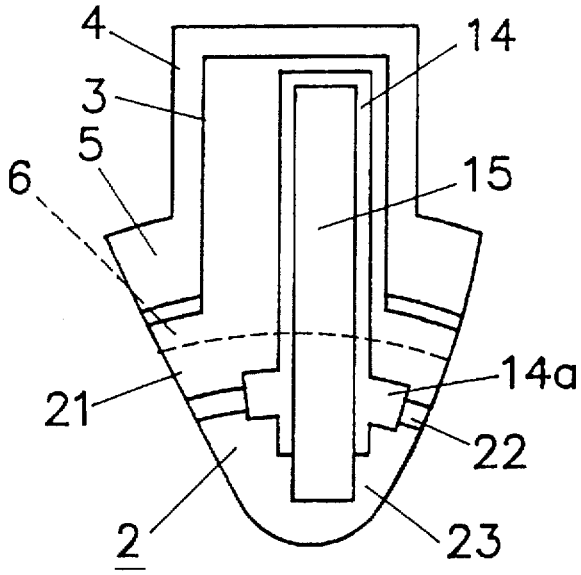

Other examples of the projection 3 are illustrated in FIGS. 6(*a*) and 6(*b*). In FIG. 6(*a*), the extension electrode 15 is formed on the projection 3 and a conductive film 15' like the extension electrode 15 is formed on the metallic surface portion of the projection 3 abutting the extension electrode 15. The conductive film 15' is formed for solving the problem of formation of a step between the extension electrode 15 on the insulating layer 14 and the metallic surface portion of the projection 3 at one side of the projection 3. When this problem is solved, the compression distortion of the connection block 12 is prevented from deflecting at a specific portion on the electrode supporting portion 4. In FIG. 6(*b*), a width of the insulating layer 14 is largely formed at a stepped portion at an edge of the piezoelectric body 22 on the diaphragm 21, which can cope with dispersion caused by sag in printing at the stepped portion of the extension electrode 15, and can assure the insulation relative to the diaphragm 21.

Figure 7A:
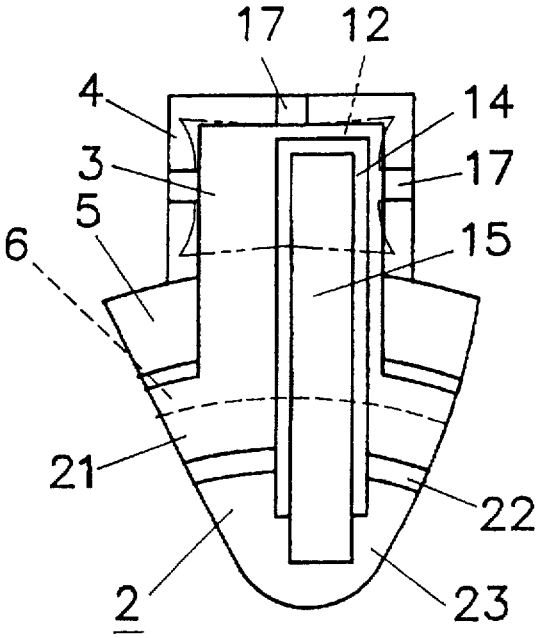
FIGS. 7(*a*) and 7(*b*) are plan views showing main portions of electrode supporting portions of the housing of the piezoelectric acoustic device according to a modification of the first embodiment.
Figure 7B:
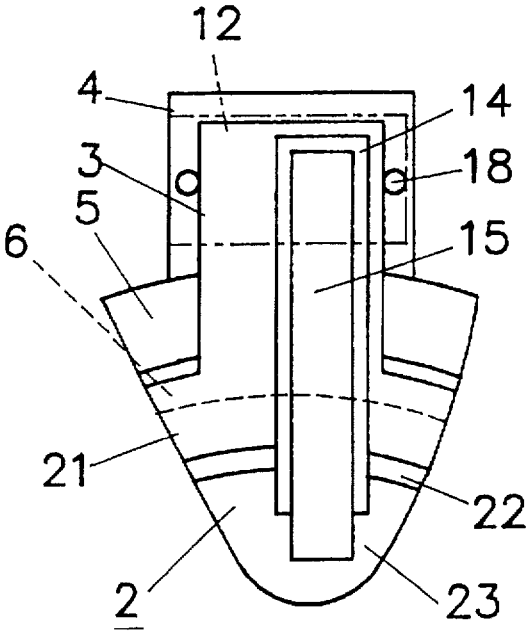

Other examples of the electrode supporting portion 4 of the peripheral wall 5 are illustrated in FIGS. 7(*a*) and 7(*b*). That is, in FIG. 7(*a*), the electrode supporting portion 4 is not formed like the groove but projections 17, 17 . . . are provided at the tip and both sides of the electrode supporting portion 4. The connection block 12 is deformed and engaged in the electrode supporting portion 4 to be fixed to the electrode supporting portion 4. Compared with the engagement of the connection block 12 into the groove-shaped electrode supporting portion 4, the connection block 12 can be easily incorporated into the electrode supporting portion 4 in FIG. 7(*a*). In FIG. 7(*b*), the electrode supporting portion 4 is not groove-shaped but flat-plate-shaped, wherein two projections 18 and 18 project from the electrode supporting portion 4 at the position not to overlap with the projection 3 of the diaphragm 21, and they are engaged with holes provided on the connection block 12 so as to hold the connection block 12. Compared with the engagement of the connection block 12 into the groove-shaped electrode supporting portion 4, the connection block 12 can be easily incorporated into the electrode supporting portion 4 in FIG. 7(*b*).

Figure 8:
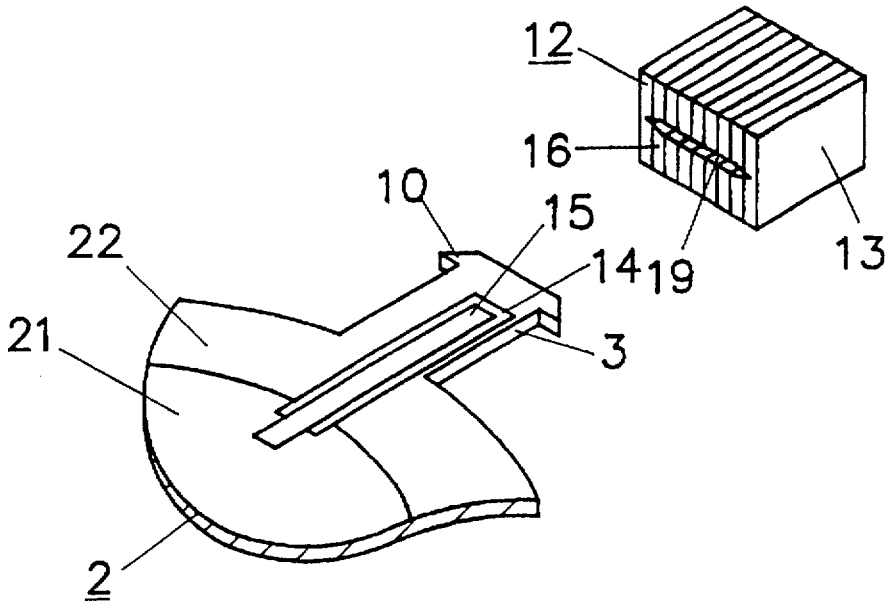
FIG. 8 is an exploded perspective view showing another example of a main portion of a temporary fixing means for fixing a connection block to the projection of the diaphragm.
Figure 9:
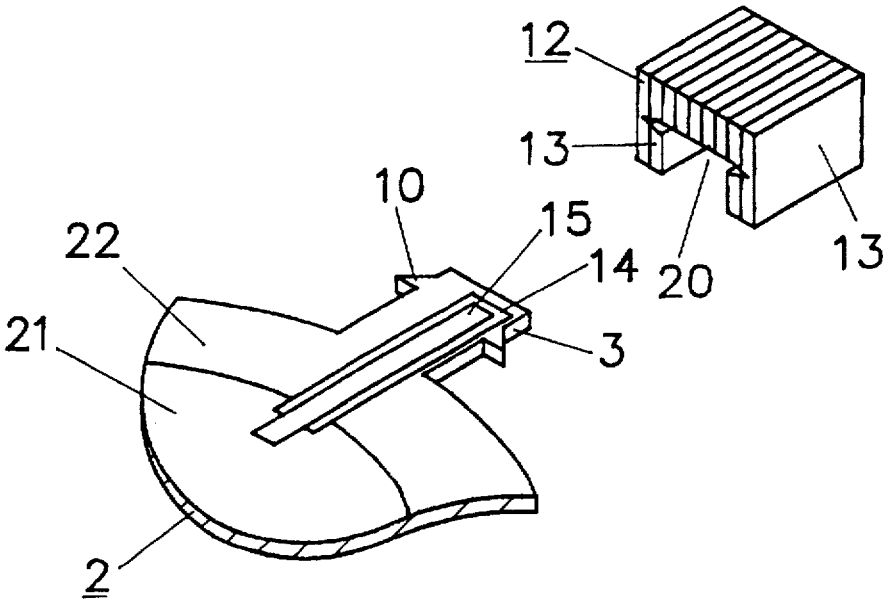
FIG. 9 is an exploded perspective view showing a still another example of a main portion of a temporary fixing means for fixing the connection block to the projection of the diaphragm.

FIGS. 8 and 9 show other examples of a temporary fixing means of the connection block 12.

In FIG. 8, a slit 19 is provided laterally at the center of the connection block 12, and the projection 3 of the diaphragm 21 is inserted into the slit 19 so as to temporarily fix the connection block 12. In this housing, so-called return protrusions 10 and 10 are provided at both sides of the tip of the projection 3 to prevent the connection block 12 from dropping off. In FIG. 9, a notch 20 is provided at a lower half portion of the connection block 12 at the center thereof so that the projection 3 of the diaphragm 21 is inserted into the notch 20 to temporarily fix the connection block 12. In this housing, so-called return protrusions 10 and 10 are provided to get out of position at both sides of the central portion of the projection 3 to prevent the connection block 12 from dropping off. In any of the connection blocks 12 in FIGS. 8 and 9, it can be easily incorporated into the electrode supporting portion 4 compared with the engagement of the connection block 12 into the groove-shaped electrode supporting portion 4. In the embodiment shown in FIGS. 8 and 9, it is preferable to support the lower surface side of the projection 3 of the diaphragm 21 directly by the electrode supporting portion 4 or by way of other members.

What is claimed is:

1. A piezoelectric acoustic device comprising:

a piezoelectric element having a metallic planar diaphragm having a main surface, said piezoelectric element further having a projection coplanar with and projecting radially outward from said diaphragm and having a first surface thereon;

a planar piezoelectric body having second and third surfaces;

electrodes provided on each of said second and third surfaces of said piezoelectric body, one electrode thereof being fixed and electrically connected to said main surface of said diaphragm;

a hollow housing for accommodating said piezoelectric element thereon and forming a resonant chamber together with said piezoelectric body;

an insulating layer for covering said first surface of said projection;

an extension electrode overlaying said first surface of said projection and said insulating layer so that said extension electrode is insulated from said projection by said insulating layer; and a separate elastic connection block, said extension electrode being electrically connected to another circuit solely through said separate elastic connection block sandwiched therebetween.

2. The piezoelectric acoustic device according to claim 1, wherein said elastic connection block has a plurality of conductive portions provided at least on the surface thereof, and wherein said conductive portions are arranged alternately in a given interval while being insulated therebetween.

3. The piezoelectric acoustic device according to claim 2, wherein said piezoelectric element, said extension electrode, said elastic connection block and said another circuit are inside said housing and wherein said first surface is a metallic surface and wherein said metallic first surface and said extension electrode are respectively electrically connected to said another circuit inside said housing by way of at least one of said plurality of conductive portions provided on said separate elastic connection block.

4. The piezoelectric acoustic device according to claim 1, wherein said elastic connection block is compressively clamped between said projection and said another circuit.

5. The piezoelectric acoustic device according to claim 4, further including said housing having a fastening means for effecting said compressive clamping of elastic connection block.

6. The piezoelectric acoustic device according to claim 1, wherein said insulating layer and said extension electrode are film bodies extending between said electrode on said piezoelectric body and said projection of said diaphragm.

7. The piezoelectric acoustic device according to claim 1, wherein said housing has an aperture and a mesh sound damper covering said aperture.

8. The piezoelectric acoustic device according to claim 1, wherein said housing has an annular step and an electrode supporting portion, said piezoelectric element being disposed on said annular step, said projection being disposed on said electrode supporting portion.

9. A piezoelectric acoustic device comprising:

a generally circular planar piezoelectric element having a metallic planar diaphragm with a planar piezoelectric body having a first electrode disposed on a first surface of said piezoelectric body and a second electrode disposed on a second surface of said piezoelectric body, said second electrode fixed and electrically connected to a first surface of said diaphragm, said piezoelectric element further having a projection radially outwardly extending from said diaphragm and coplanar therewith;

an insulating layer covering a part of said projection;

an extension electrode overlaying said insulating layer so as to be insulated from said projection by said insulating layer, said extension electrode being electrically connected to said first electrode;

housing means for accommodating said piezoelectric element therein and forming a resonant chamber together with said piezoelectric body, said housing means having a first shell and a second shell, said second shell having an annular step and an electrode supporting portion extending radially outwardly from said second shell, said piezoelectric element disposed within said second shell such that part of said piezoelectric element is supported by said annular step and said projection is supported by said electrode supporting portion; and connector means for electrically connecting said extension electrode to another electrode on said first shell, said connector means being sandwiched between said extension electrode and said another electrode and solely providing the electrical connection therebetween.

10. The piezoelectric acoustic device according to claim 9, wherein said connector means is a separate elastic connection block.

11. The piezoelectric acoustic device according to claim 10, wherein said elastic connection block has a plurality of conductive portions provided at least on the surface thereof, and wherein said conductive portions are spaced from one another with insulation therebetween.

12. The piezoelectric acoustic device according to claim 10, wherein said first shell includes a printed circuit board attached thereto;

wherein a metallic surface portion is disposed on said projection, said surface portion and said extension electrode being respectively electrically connected to circuit patterns on said printed circuit board solely through at least one of said plurality of conductive portions provided on said separable elastic connection block; and fastening means for connecting said first and second shells such that said elastic connection block becomes compressively clamped between said projection of said piezoelectric element and said printed circuit board.

13. The piezoelectric acoustic device according to claim 12, further including a conductive film step disposed on said metallic surface portion and operable to electrically connect between said metallic surface portion and one of said conductive portions of said elastic connection block, said conductive film step preventing compression distortion of said elastic connection block when said elastic connection block is compressively clamped.

14. The piezoelectric acoustic device according to claim 9, wherein said second shell has an aperture therein and a mesh sound damper covering said aperture.

* * * * *